United States Patent [19]

Quakenbush

[11] Patent Number: 4,542,447

[45] Date of Patent: Sep. 17, 1985

[54] FLASHLIGHT ATTACHMENT FOR FIREARMS

[76] Inventor: Timothy L. Quakenbush, Mattoon, Ill.

[21] Appl. No.: 611,854

[22] Filed: May 18, 1984

[51] Int. Cl.[4] ..... F21L 7/00; F41G 1/34

[52] U.S. Cl. ..... 362/183; 42/1 A; 200/60; 362/108; 362/110; 362/114; 362/191; 362/200; 362/205; 362/253; 362/295; 362/368; 362/370; 362/396

[58] Field of Search ..... 362/109, 110, 114, 112, 362/111, 113, 190, 191, 205, 183, 396, 108, 200, 253, 295, 368, 370; 42/1 A; 200/60

[56] References Cited

U.S. PATENT DOCUMENTS

| | | | |
|---|---|---|---|
| 689,547 | 12/1901 | James | 362/113 |
| 1,615,409 | 1/1927 | Selden et al. | 362/114 |
| 1,993,979 | 3/1935 | Reed | 362/113 |
| 2,093,514 | 9/1937 | Cornett et al. | 362/114 |
| 2,132,063 | 10/1938 | Whaley | 362/110 |
| 2,314,061 | 3/1943 | Whaley | 362/110 |
| 2,450,584 | 10/1948 | Dodge | 362/114 |
| 2,597,565 | 5/1952 | Chandler et al. | 362/110 |
| 3,114,362 | 12/1963 | Hellman | 362/113 |

*Primary Examiner*—Stephen J. Lechert, Jr.
*Assistant Examiner*—Howard J. Locker
*Attorney, Agent, or Firm*—Harvey B. Jacobson

[57] ABSTRACT

A flashlight attachment for a firearm, for illuminating a target in darkness, comprises a lightweight flashlight casing which clips underneath the firearm barrel, and a touch switch for operating same which is connected to circuit leads extending from the casing, the touch switch being releasably secured to the firearm handle by Velcro fasteners so that it may be operated by hand pressure by a user of the firearm without the user having to release his or her grip on the handle. The attachment may be speedily and efficiently attached to a firearm and removed therefrom.

10 Claims, 6 Drawing Figures

FLASHLIGHT ATTACHMENT FOR FIREARMS

BACKGROUND OF THE INVENTION

This invention relates to a flashlight attachment for firearms, particularly relatively short range handguns such as pistols, revolvers and the like, but which may also be applied to other forms of firearm.

There is a need for a form of lightweight flashlight attachment for a firearm which can be easily transported by a user and quickly and efficiently applied to the firearm when required, for example to assist in locating and illuminating a target in darkness. Such devices may be used to advantage, for example, by police, security guards, private detectives and the like for nighttime operations.

STATEMENT OF PRIOR ART

The following U.S. patents pertain to firearms provided with lighting devices and the like. None of these, however, discloses a flashlight attachment for a firearm having the features of the present invention. U.S. Pat. Nos. 789,227; 982,280; 995,867; 1,088,502 and 4,398,716.

SUMMARY OF THE INVENTION

The invention provides a lightweight flashlight attachment for a firearm having one or more of the following characteristics, namely, the ability to readily attach to or detach from a firearm in a matter of seconds, the ability to provide accurate light-beam alignment with the firearm sights, the ability to be operated separately as a flashlight, and the ability to be easily disassembled for fast and efficient replacement of batteries, bulbs and the like.

For example, an attachment in accordance with the invention may comprise a lightweight flashlight having a plastic casing of generally flat rectangular shape and of a size to fit conveniently in the palm, the flashlight incorporating, inter alia, battery and light bulb holders and circuitry commonly associated with hand-held flashlights, a pair of spaced bifurcated spring clips on one of the narrower sides of the rectangular casing for clipping onto a firearm barrel from below so as to releasably attach the flashlight to the firearm with the casing suspended beneath the barrel, and switch means for the flashlight circuitry including circuit leads extending from the flashlight casing to a touch-type switch having means for releasably securing same in strategic location on the firearm handle for readily applied manual pressure on the touch switch to operate the flashlight without a user having to release his or her grip on the handle.

The touch-type switch may, for example, be in the form of a pad incorporating a pair of contacts associated with the respective circuit leads, and means normally urging the contacts apart, so that manual pressure is required to be applied to the switch to engage the contacts and close the circuit operating the flashlight. The pad may have a Velcro or like tab on one surface for releasably attaching same to a complementary tab secured on the handle of the firearm by suitable means, for example, a tight elastic band. Alternatively, the touch-type switch may be incorporated in a band for attachment around a firearm handle.

It will be understood that the attachment may be speedily and efficiently applied to a firearm simply by clipping the flashlight casing under the barrel and dabbing the touch switch onto the Velcro tab on the firearm handle (or applying the switch-incorporating band to the handle). The attachment is equally effectively removed from the firearm.

The flashlight casing may be provided with a belt clip or the like for carrying same on a user's belt when not in use, and the casing may also have a further Velcro tab on one surface for attachment of the touch-type switch when the attachment is not in use.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
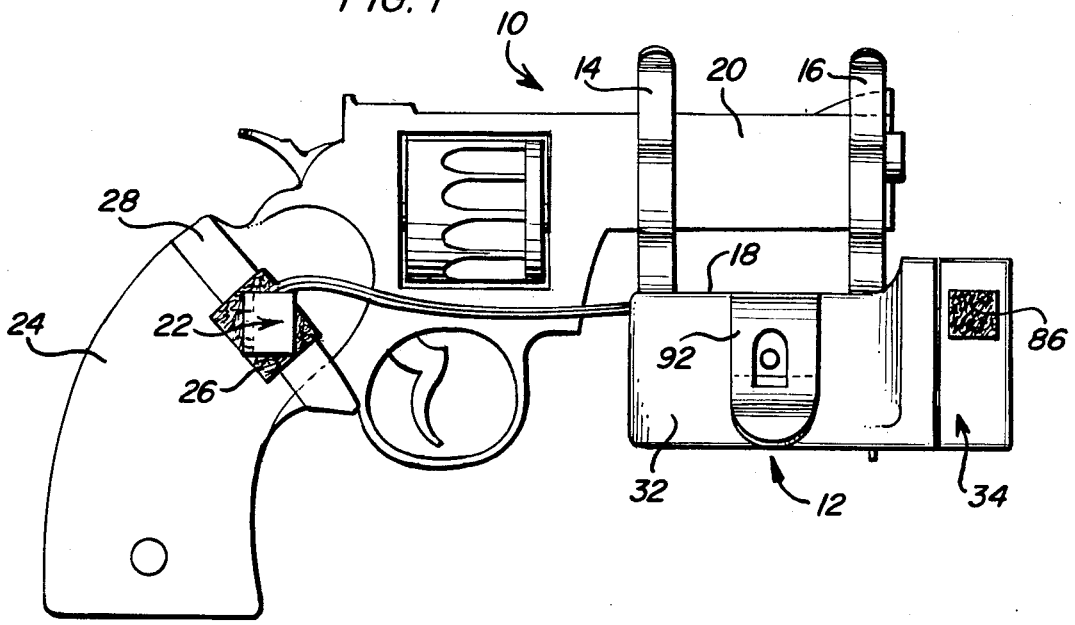
FIG. 1 is a side elevational view of a revolver equipped with a flashlight attachment in accordance with the invention.
Figure 2:
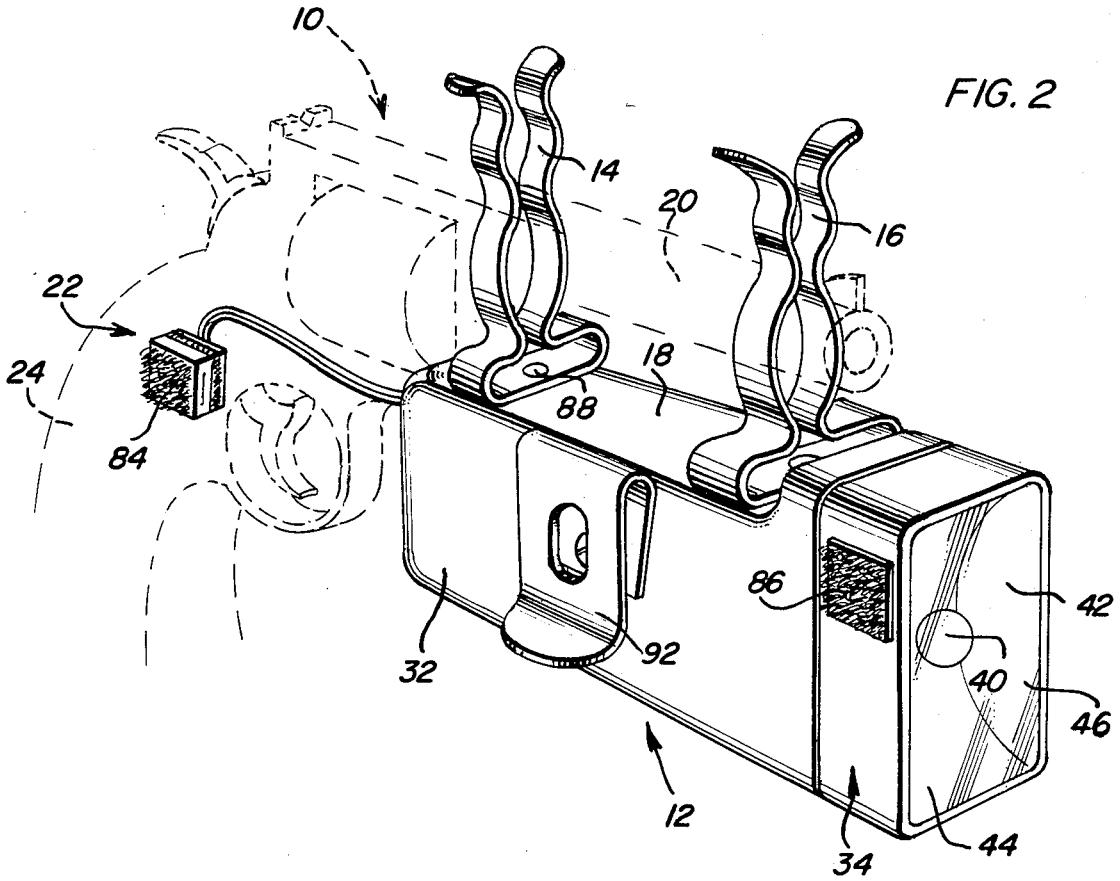
FIG. 2 is an enlarged perspective view of the attachment with the revolver shown in phantom.
Figure 3:
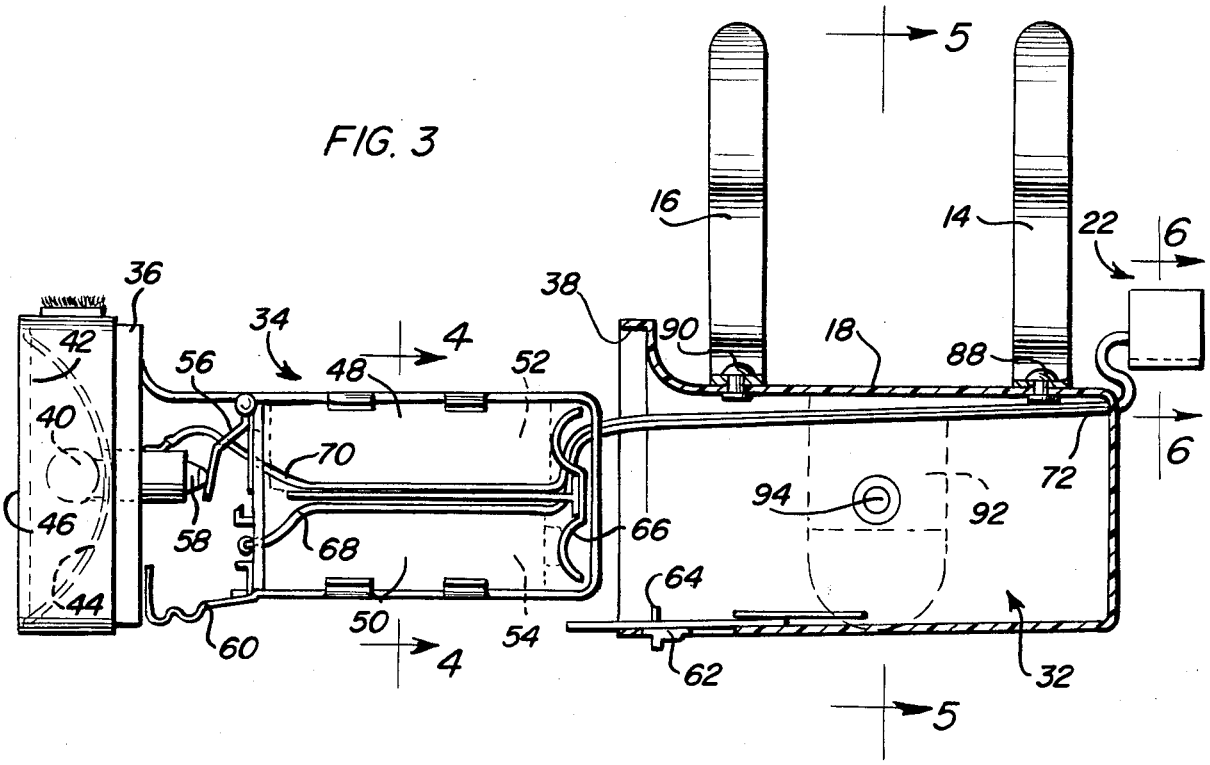
FIG. 3 is an enlarged sectional side view of the attachment showing separated casing parts thereof.
Figure 4:
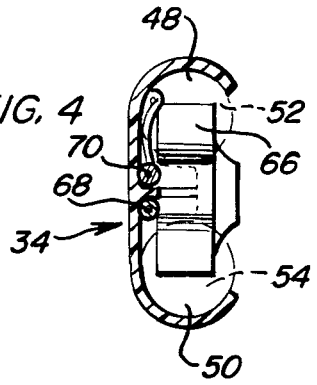
FIG. 4 is a sectional view on line 4—4 of FIG. 3.
Figure 5:
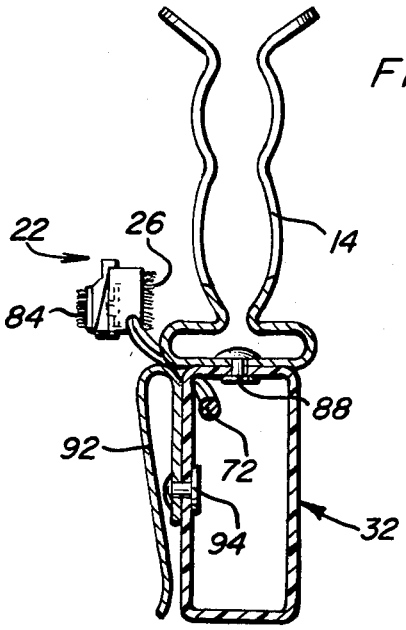
FIG. 5 is a sectional view on line 5—5 of FIG. 3.

Referring initially to FIGS. 1 and 2 in particular, a flashlight attachment for a revolver 10 comprises a flashlight casing 12 of generally flat rectangular form with a pair of bifurcated spring clips 14, 16 on one flat surface 18 thereof which snap onto the barrel 20 of the revolver from below to releasably secure the casing thereto, the casing incorporating customary flashlight components to be described below, and the attachment including a touch-type switch 22 for operating the flashlight, the switch being releasably secured to the handle 24 of the revolver, for example, by a Velcro tab 26 on the back of the switch which engages a complementary tab 28 on an elastic band 30 or the like tightly surrounding the handle, or on other attachment means.

Flashlight casing 10 comprises a hollow receiver portion 32 and a carrier portion 34 which fits into the receiver portion and has a rim 36 for frictionally engaging a lip 38 of the receiver portion. The carrier portion may have sprung detents (not shown) which engage in openings (also not shown) on the sides of the receiver portion to retain the portions in assembled condition. Both the receiver portion and carrier portion may be lightweight plastic moldings.

Receiver portion 34 carries a standard flashlight bulb 40 at its forward end in a compartment 42 provided with a reflector 44 and lens 46. Behind bulb 40 are a pair of compartments 48, 50 for standard AA 1.5 volt flashlight batteries 52, 54. A first spring contact 56 is associated with compartment 48 for connecting the positive terminal of battery 52 to contact 58 of bulb 40. A second spring contact 60 is associated with compartment 50 for selectively connecting the negative terminal of battery 54 to the bulb under the control of a slide-type switch 62 on receiver portion 32 of the casing, which has a lug 64 for depressing contact 60 into engagement with the bulb, with an electric circuit being completed through a bridging contact 66 at the base of compartments 48, 50 connecting the negative terminal of battery 52 with the positive terminal of battery 54. Thus, switch 62 enables the device to be operated in the manner of a conventional flashlight when, for example, it is detached from revolver 10. Further, insulated leads 68, 70 extend respectively from contact 60 and from a conducting portion of bulb 40 through an opening 72 in receiver portion 32 to respective contacts 74, 76 of touch switch 22, whereby the bulb can optionally be operated by means of the touch switch.

Figure 6:
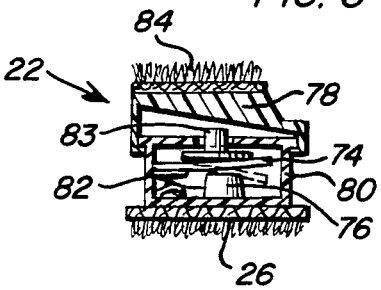
FIG. 6 is a sectional view on line 6—6 of FIG. 3.

Touch switch 22 (FIG. 6) is of conventional form having a pair of telescopically connected sections 78, 80 forming a container housing contacts 74, 76. The contacts are urged apart by a spring 82, and a push button 83 depressed by manual pressure exerted between sections 78, 80 closes the contacts against the spring action. Velcro tab 26 is secured on the outer surface of section 80 of the switch, and the outer surface of section 78 carries another Velcro tab 84 for engagement with a complementary tab 86 on the exterior of carrier portion 34 of the flashlight casing for securing the touch switch when it is removed from the revolver handle.

Clips 14, 16 may be attached to carrier portion 32 by rivets 88, 90 and a belt clip 92 may also be attached to a side surface of the carrier portion by means of a rivet 94 for securing the casing to a user's belt when it is not in use. Packing elements (not shown) may be provided for use in the base portions of clips 14, 16 for adjusting the angularity of the flashlight casing on the firearm barrel whereby the direction of a light beam emanating from bulb 40 may be suitably adjusted so as to accurately align on a target.

The described attachment is speedily and efficiently installed on a firearm simply by snapping clips 14, 16 on the barrel and attaching the touch switch. The attachment is lightweight and readily operated through the touch switch by thumb pressure without a user having to move his or her hand from the firearm handle. Further, band 28 can be moved on the handle to a position comfortable to different users, and switch 22 can be positioned on either side of the handle for left or right hand use. Also, either one of the Velcro tabs on the switch can be used for attaching it to tab 26 on the revolver handle or to tab 86 on the flashlight casing. The attachment can be equally easily removed from a firearm and carried on a user's belt or the like for subsequent use.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A flashlight attachment for a firearm comprising a flashlight casing provided with a flashlight bulb, battery holding means and electrical circuit forming means for providing an electrical connection between the bulb and a battery in the holding means, attachment means for releasably securing the flashlight casing to a firearm in strategic position relative to the firearm barrel for directing a light beam emanating from the bulb toward a target, the circuit forming means including leads extending from the casing to a touch switch for closing the circuit, and the attachment further including means for releasably securing the touch switch to a handle of the firearm in position for operation through manual pressure thereon by a user gripping the firearm without the user having to release his or her grip wherein the means for releasably securing the touch switch on the firearm handle comprises a first friction fastener tab on the touch switch, a second complementary friction fastener tab, and means for securing the second friction fastener tab on the firearm handle wherein the means for securing the second friction fastener tab on the handle comprises a resilient handle-embracing band on which the second tab is secured.

2. The invention of claim 1 wherein the touch switch comprises a pair of telescopically connected elements defining a compartment housing a pair of switch contacts connected to respective ones of said leads, and means urging the contacts apart whereby pressure closing the telescopic elements together is effective to overcome the urging means and close the contacts, and further wherein the first friction fastener tab is secured to one of said telescopically connected elements.

3. The invention of claim 2 including a third friction fastener tab on the other of said telescopically connected elements.

4. The invention of claim 1 including a further friction fastener tab on the flashlight casing complementary to the first friction fastener tab for securing the touch switch to the casing when disengaged from the firearm handle.

5. The invention of claim 1 wherein the electrical circuit forming means includes a switch contact and a manually operable switch associated with the flashlight casing for selectively closing the circuit independently of the touch switch.

6. A flashlight attachment for a firearm comprising a flashlight casing provided with a flashlight bulb, battery holding means and electrical circuit forming means for providing an electrical connection between the bulb and a battery in the holding means, attachment means for releasably securing the flashlight casing to a firearm in strategic position relative to the firearm barrel for directing a light beam emanating from the bulb toward a target, the circuit forming means including leads extending from the casing to a touch switch for closing the circuit, and the attachment further including means for releasably securing the touch switch to a handle of the firearm in position for operation through manual pressure thereon by a user gripping the firearm without the user having to release his or her grip wherein the flashlight casing comprises a receiver portion and a carrier portion for removable receipt in the receiver portion, the carrier portion including said bulb, said battery holding means and said circuit forming means, and said receiver portion including said attachment means and wherein said leads extend to the touch switch through a hole in an end wall of the receiver portion.

7. The invention of claim 6 wherein the attachment means comprises a pair of bifurcated spring clips for releasably embracing a firearm barrel from below so as to suspend the flashlight casing beneath the barrel.

8. The invention of claim 7 wherein the receiver portion of the flashlight casing is of generally flat rectangular form and the clips are secured to one of the narrower sides thereof.

9. The invention of claim 7 wherein the carrier portion of the flashlight casing is provided with a belt clip for attaching same to a user's belt and the like.

10. The invention of claim 6 wherein the means for releasably securing the touch switch on the firearm handle comprises a first friction fastener tab on the touch switch, a second complementary friction fastener tab, and a resilient handle-embracing band on which the second tab is secured for retaining the second friction fastener tab on the firearm handle, the attachment further including another friction fastener tab on the flashlight casing complementary to the first friction fastener tab for securing the touch switch to the casing when disengaged from the firearm handle.

* * * * *